United States Patent [19]

Yamamoto

[11] 3,956,854

[45] May 18, 1976

[54] APPARATUS FOR PREVENTING THE ACCIDENTAL DETACHMENT OF THE HORIZONTALLY ROLLING SASHES OF A WINDOW OF THE LIKE FROM THE SUPPORTING FRAME

[75] Inventor: Yukio Yamamoto, Kurobe, Japan

[73] Assignee: Yoshida Kogyo K.K., Japan

[22] Filed: Dec. 27, 1974

[21] Appl. No.: 536,805

[30] Foreign Application Priority Data

Dec. 29, 1973 Japan ..... 49-3169[U]

[52] U.S. Cl. ..... 49/425; 16/100

[51] Int. Cl.[2] ..... E05D 13/02

[58] Field of Search ..... 49/425; 16/97, 98, 100

[56] References Cited

UNITED STATES PATENTS

| | | | |
|---|---|---|---|
| 1,131,322 | 3/1915 | Bower | 49/425 X |
| 3,033,285 | 5/1962 | Banner | 49/425 |

FOREIGN PATENTS OR APPLICATIONS

| | | | |
|---|---|---|---|
| 243,227 | 2/1963 | Australia | 49/425 |
| 1,496,188 | 8/1967 | France | 49/425 |

*Primary Examiner*—Kenneth Downey

*Attorney, Agent, or Firm*—Bucknam and Archer

[57] ABSTRACT

In a sash window or like panel assembly wherein each sash is rollable horizontally over a rail on the sill of a generally rectangular supporting frame, each roller of the sash is rotatably supported by an inverted-U-shaped roller support which is fixedly mounted in a selected position in a downwardly opening channel formed in the bottom horizontal member of the sash. The roller support has, typically, a pair of resilient hooks fashioned by inwardly folding the bottom ends of its opposed side portions, which hooks are engageable with respective overhangs formed on both sides of the rail throughout its full length.

3 Claims, 3 Drawing Figures

APPARATUS FOR PREVENTING THE ACCIDENTAL DETACHMENT OF THE HORIZONTALLY ROLLING SASHES OF A WINDOW OF THE LIKE FROM THE SUPPORTING FRAME

BACKGROUND OF THE INVENTION

This invention relates generally to windows, doors, shutters, window screens and like panel assemblies of the type having one or more sashes mounted within a generally rectangular supporting frame for horizontal rolling movement. More specifically, the invention is directed to improved means for preventing the accidental detachment of the horizontally rolling sash or sashes from over the sill of the supporting frame.

According to an example of the prior art perhaps closest to the improved means of this invention, a separate hook member engageable with the rail on the sill of a supporting frame for a sash window or the like is screwed to a structure rotatably supporting each roller of the sash. This known arrangement necessitates the extra assembly operation of screwing the several hook members to the respective roller supporting structures of the sash. Moreover, the bottom horizontal member of each sash must be apertured to permit insertion of a screwdriver for use in securing the hook members to the roller supporting structures, so that the manufacture of the sashes also requires the expenditure of extra time and labor.

SUMMARY OF THE INVENTION

It is, therefore, among the objects of this invention to provide, in a window or like panel assembly having at least one sash of horizontally rolling type, improved means for holding the sash on the sill of a rectangular supporting frame practically without any possibility of accidental detachment.

Another object of the invention is to provide the means of the above described character which are equally well adaptable for various panel assemblies, such as windows, doors, shutters and window screens, that include a horizontally rolling sash or sashes.

With these and other objects in view, this invention provides, in a window or the like wherein at least one sash is rollable horizontally within a supporting frame, the novel combination which includes a rail formed on the sill of the supporting frame and having at least one overhang extending the full length thereof. A roller support in the shape of an inverted "U", rotatably holding each roller of the sash between its pair of opposed side portions, is fixedly mounted in a selected position in a downwardly opening channel formed in the bottom horizontal member of the sash throughout its full length, in such a manner that the roller is held in rolling engagement with the rail on the sill. A hook of relatively rigid but suitably resilient material, engageable with the overhang of the rail, is arranged at the bottom end of at least one of the side portions of the roller support.

Preferably, the hook may be formed by inwardly folding the bottom end of the side portion of the roller support. It is also preferable to provide a pair of overhangs on the opposite sides of the rail and, correspondingly, to fold the bottom ends of both side portions of the roller support toward each other to provide a pair of hooks engageable with the respective overhangs of the rail.

According to the above summarized novel combination of the invention, the hooks constituting essentially integral parts of the roller supports resiliently yield away from the rail when the sash is being installed within the supporting frame, and become engageably disposed under the overhang or overhangs of the rail upon completion of sash installation. The possibility of accidental disengagement of the rollers from the rail can thus be substantially precluded through the extremely simple procedure. There is no need for screwing separate hook members to the sash, or for forming apertures in the bottom horizontal member of the sash for the insertion of a screwdriver.

The features which are believed to be novel and characteristic of this invention are set forth in particular in the claims appended hereto. The invention itself, however, both as to its construction and mode of operation, together with the further objects and advantages thereof, will be apparent from the following description of preferred embodiments when read in connection with the accompanying drawings in which like reference characters refer to like parts throughout the several views.

DESCRIPTION OF THE PREFERRED EMBODIMENTS

Figure 1:
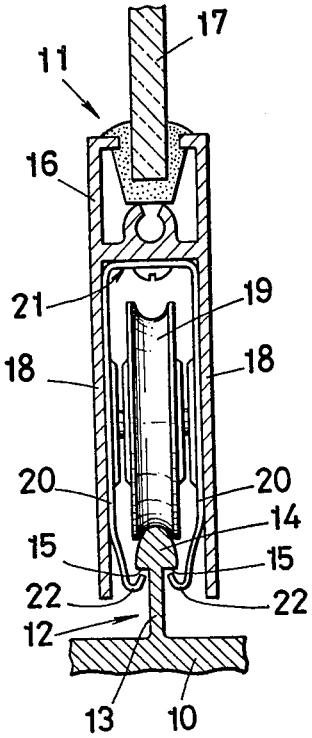
FIG. 1 is a partial vertical sectional view showing a preferred form of the means for preventing the accidental detachment of a horizontally rolling sash of a dual sash window or the like from the sill of a supporting frame.

The invention will now be described in terms of a typical embodiment thereof illustrated in FIG. 1. The reference numeral 10 in the drawing designates the sill of a generally rectangular supporting frame for a dual sash window or the like, which frame is to be rigidly set in the opening of an enclosing wall or the like. In addition to the sill 10, the supporting frame comprises, of course, the header and the pair of jambs that are not shown in the drawing.

Installed within the supporting frame are, typically, a pair of sashes 11 which are rollable horizontally along respective rails 12 extending the full length of the sill 10 in parallel, closely spaced arrangement. Only one of the sashes 11 together with the associated rail 12 is shown in the drawing for the sake of simplicity of illustration. The rail 12 includes an upstanding web 13 terminating in a thickened head 14, the latter forming a pair of overhangs 15 that are arranged on the opposite sides of the rail throughout the complete length thereof.

The sash 11 comprises a bottom horizontal member 16, a top horizontal member and side vertical members extending around and embracing the periphery of a pane or panel 17 of glass or other suitable material. Also for the sake of simplicity of illustration, the top horizontal member and side vertical members of the sash 11 are not shown.

The bottom horizontal member 16 of the sash 11 has a pair of opposed rims 18 extending downwardly therefrom to define a downwardly opening channel which extends the full length of the bottom horizontal member and which accommodates aligned rollers 19 for rolling engagement with the thickened head 14 of the rail 12.

According to the novel concepts of this invention, each roller 19 is rotatably supported between the pair of opposed side portions 20 of a roller support 21 in the shape of an inverted "U". The roller support 21 is made of relatively rigid but suitably resilient material, and its side portions 20 are folded inwardly or toward each other at their bottom ends to provide a pair of hooks 22. The roller support 21 together with its roller 19 can be screwed or otherwise fixedly mounted in a selected position between the opposed rims 18 of the bottom horizontal member 16 of the sash 11.

Thus, when the sash 11 is installed within its rectangular supporting frame, the thickened head 14 of the rail 12 forces the hooks 22 of each inverted-U-shaped roller support 21, which have suitable resiliency as aforesaid, away from each other to intrude therebetween and hence to make rolling engagement with the roller 19 rotatably supported by the roller support. As illustrated, the hooks 22 of each roller support 21 are normally held under the respective overhangs 15 of the rail 12 with suitable clearances therebetween, so that the sash is free to roll over the rail. As the sash is about to be accidentally detached from the supporting frame, however, either or both of the hooks 22 become engaged by the corresponding overhang or overhangs of the rail 12 to retain the sash in position over the sill 10.

Figure 2:
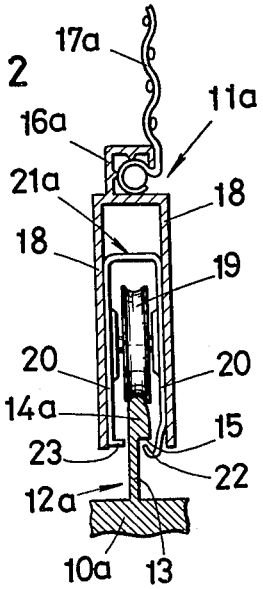
FIG. 2 is a view similar to FIG. 1 but showing another preferred embodiment of the invention as adapted to a window screen.

In another preferred embodiment of the invention illustrated in FIG. 2, the inventive concepts are applied to a window screen designed to rollably fit into the supporting frame of a window to prevent the intrusion of insects when the window is open. The window screen includes netting 17*a* of wire or other material which is set within a sash 11*a* of which the bottom horizontal member 16*a* is a part.

As in the preceding embodiment, the bottom horizontal member 16*a* of the sash 11*a* has the pair of opposed rims 18 defining the downwardly opening channel. Inverted-U-shaped roller supports 21*a*, each rotatably supporting the roller 19 between its opposed side portions 20, are securely mounted in selected positions between the opposed rims 18 of the bottom horizontal member 16*a* in a suitable manner. Only one of the side portions 20 of each roller support 21*a*, which is made of relatively rigid but suitably resilient material, has its bottom end folded inwardly to provide the hook 22, whereas the other side portion 20 has its bottom end bent inwardly at a right angle, as indicated by the numeral 23.

The sill 10*a* constituting a part of the generally rectangular supporting frame for at least one such window screen has a rail 12*a* thereon which includes the upstanding web 13 with a thickened head 14*a* forming the overhang 15 only on one side of the rail where the hook 22 of the roller support 21*a* is to be arranged.

As may be apparent from the foregoing description, the thickened head 14*a* of the rail 12*a* forces the hook 22 at the bottom end of one of the side portions 20 of each inverted-U-shaped roller support 21*a* away from the other side portion and intrudes between the side portions to establish rolling engagement with the roller 19 when the sash 11*a* of the window screen is installed within the supporting frame. Since the hook 22 of each roller support 21*a* is normally engageably held under the overhang 15 of the rail 12*a*, and since the web 13 of the rail is held between the relatively narrow spacing between the hook 22 and the inward bent 23 of each roller support, the possibility of accidental detachment of the window screen from over the sill 10*a* is effectively precluded.

Figure 3:
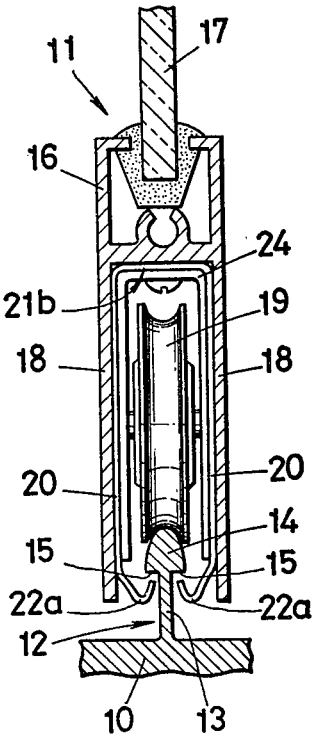
FIG. 3 is a view also similar to FIG. 1 but showing a slight modification of the embodiment shown therein.

FIG. 3 illustrates a slight modification of the embodiment shown in FIG. 1, which modification includes an inverted-U-shaped member 24 made of relatively rigid but suitably resilient material. Other details of construction and operation will be apparent from the foregoing description of FIG. 1.

It may be mentioned that the improved means of this invention are employable advantageously in conjunction with the rollers of adjustable height type for horizontally moving sashes, because then the accidental detachment of the sashes can be prevented regardless of the positions of the rollers adjustably varied up or down with respect to the sashes.

Although the invention has been disclosed in very specific aspects thereof, it is understood that all matter described herein or shown in the accompanying drawings is meant purely to illustrate or explain and not to impose limitations upon the invention. The invention, therefore, should and is intended to be construed broadly and in a manner comprehensive of various modifications falling within the scope of the following claims.

What is claimed is:

1. In a sash assembly having rollers that engage a generally horizontal rail to accommodate the movement of the sash therealong, the improvement which comprises in combination at least one overhang ledge extending along said rail; means including walls defining a downwardly opening channel on said sash; said rail extending upwardly into said channel to position said ledge inside the channel and between the walls thereof; a plurality of rollers; a plurality of roller supports each in the shape of an inverted "U" and including a pair of opposed side portions between which a corresponding roller is supported, each roller support being fixedly mounted in a selected position in said channel to hold the corresponding roller in rolling engagement with said rail; and a hook at the end of at least one of said side portions of the roller support, said hook being resiliently deformable to pass over the upper portion of said rail to allow placement of the roller in engagement therewith, and said hook being disposed to normally assume a position underlying said ledge to resist disengagement of the roller from said rail, the deformability of said hook being limited by a corresponding wall of the channel.

2. The improvement according to claim 1 wherein said hook is integrally connected to said side portion of the roller support.

3. The improvement according to claim 1 including a pair of said hooks each integrally connected to a corresponding side portion of the roller support, and wherein said rail has a pair of opposite overhang ledges, each hook being disposed to normally underly a corresponding ledge.

* * * * *